United States Patent [19]

Raus et al.

[11] Patent Number: 4,544,225

[45] Date of Patent: Oct. 1, 1985

[54] CONNECTOR LATCH

[75] Inventors: Robert W. Raus, Fairport; Sam E. Stewart, Rochester, both of N.Y.

[73] Assignee: Xerox Corporation, Stamford, Conn.

[21] Appl. No.: 623,042

[22] Filed: Jun. 21, 1984

[51] Int. Cl.[4] ..... H01R 13/631

[52] U.S. Cl. ..... 339/91 R; 339/75 R

[58] Field of Search ..... 339/91 R, 75 R, 75 M; 403/289, 302, 338; 285/326, 364, 406

[56] References Cited

U.S. PATENT DOCUMENTS

| | | | |
|---|---|---|---|
| 425,773 | 4/1890 | Franken | 285/320 |
| 3,575,685 | 4/1971 | Gley | 339/75 |
| 3,648,223 | 3/1972 | McCray | 339/75 M |
| 3,824,525 | 7/1974 | Keller | 339/91 R |
| 3,977,748 | 8/1976 | Gruhn et al. | 339/75 M |
| 4,367,003 | 1/1983 | Frantz | 339/91 R |

FOREIGN PATENT DOCUMENTS

| | | | |
|---|---|---|---|
| 2812901 | 9/1978 | Fed. Rep. of Germany | 339/75 M |
| 177096 | 3/1922 | United Kingdom | 285/406 |
| 678729 | 9/1952 | United Kingdom | 285/406 |
| 196273 | 5/1967 | U.S.S.R. | 285/406 |

*Primary Examiner*—John McQuade

*Attorney, Agent, or Firm*—Ronald F. Chapman

[57] ABSTRACT

The present invention is concerned with a pivotable connector latch for securing together a pair of mating electrical connector members. The latch includes a pivot end secured to one end of one of the electrical connector members and a clamp end having a U-shaped member including one leg with a resilient spring for snapping the latch onto another end of the connector member. An elongated locking section of the latch, with an elongated lip between the pivot end and the clamp end fixedly secures the connector members together. The other leg of the U-shaped member is a straight clip section with a beveled edge for engaging one of the connector members.

7 Claims, 4 Drawing Figures

FIG. 1
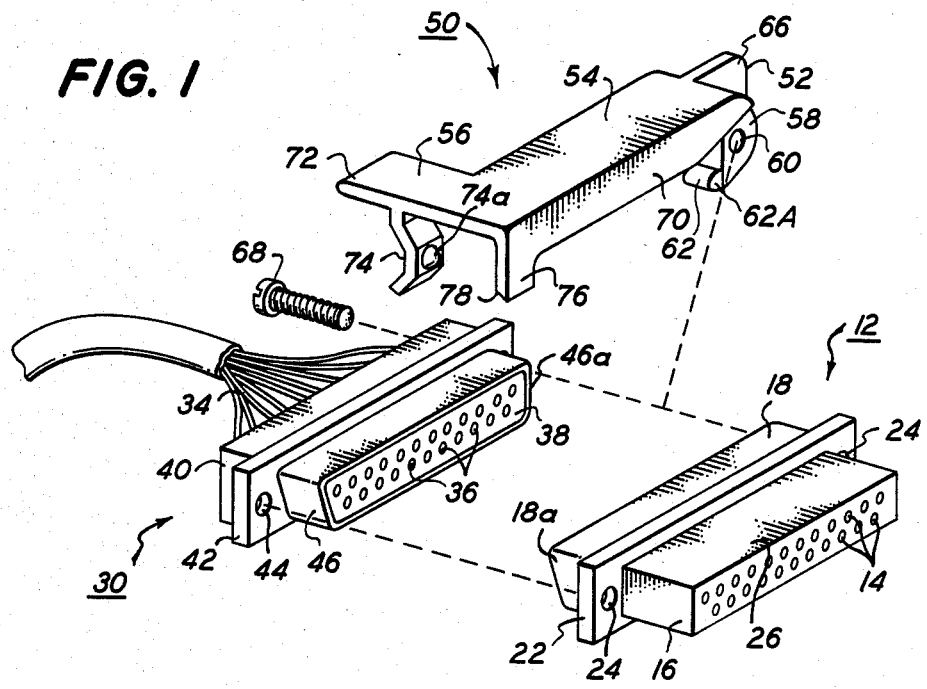
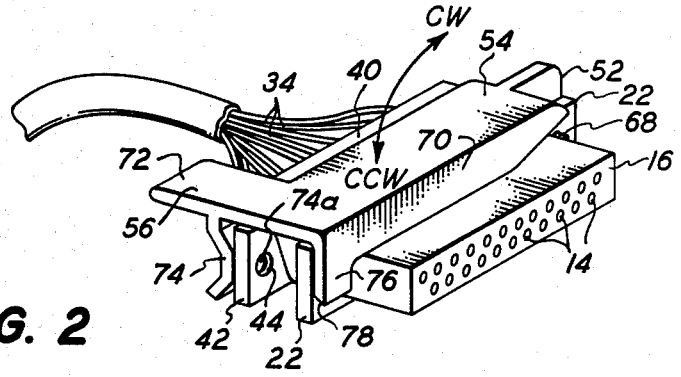
FIG. 2
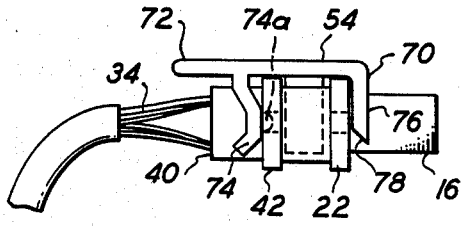
FIG. 3
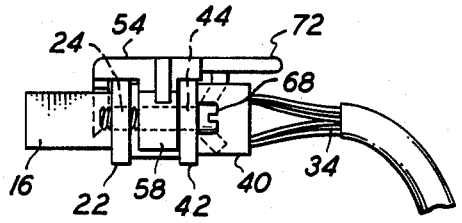
FIG. 4

CONNECTOR LATCH

This invention relates to the mating of electrical connectors, and in particular to a pivotable connector latch.

It is well known in modern day mass production of machines to provide snap together electrical terminal connections throughout the machine in order that components may be electrically interconnected during assembly with a minimum loss of time and effort. However, there is often a difficulty that the terminal connections become loose or disconnected under the stress of shipment or during normal operation. The occurrence of loose fitting electrical connections can be particularly prevalent in crowded, unaccessible locations where assembly and service personnel find difficulty in making the proper connective engagement.

The prior art is replete with electrical connector devices. For example, U.S. Pat. No. 3,648,223 shows a lock collar for securing electrical terminals in a connector head. U.S. Pat. No. 3,575,685 discloses a latch assembly having a pair of handles movably mounted on each side of the assembly for forcing and locking electrical pins into frictional engagement. Many patents describe methods for latching and releasing electrical connectors such as described in U.S. Pat. No. 4,367,003 in which the latching mechanism, a spring hold down tab, is operable from one end of the connector.

U.S. Pat. No. 3,575,685 is an example of an assembly needing a latch on either side. U.S. Pat. No. 425,773 discloses a latch pivotably attached to one connector half in a hose coupling, and pivoting about an axis parallel with the line of connector engagement. The other connector half has a flange extending transerse to the line of the connector engagement, and the latch has a flange or rib adapted to seat behind the connector flange when the connector halves are engaged and the latch is pivoted into latching position. U.S. Pat. No. 3,977,748 discloses a zero insertion force connector assembly in which a pair of connector housings are initially moved together with no engagement between the terminals. The housings are subsequently moved transversely to close individual pairs of terminals.

A difficulty with many of the prior art connectors was the relatively complex design and rather close tolerances to produce and assemble the connector. Another difficulty with the prior art connectors is that they are often impractical and are not easily accessible within the machine. It is, therefore, an object of the present invention to provide a new and improved connector latch. Another object of the present invention is to provide a connector latch that is of a relatively simple design and easy to manufacture. It is still a further object of the present invention to provide a flexible connector latch that is easily adapted to various connector assemblies.

Further objects and advantages of the present invention will become apparent as the description proceeds and the features of novelty characterizing the invention will be pointed out with particularity in the claims annexed to and forming a part of this specification.

Briefly, the present invention is concerned with a pivotable connector latch for securing together a pair of mating electrical connector members. The latch includes a pivot end secured to one end of one of the electrical connector members and a clamp end having a U-shaped member including one leg with a resilient spring for snapping the latch onto another end of the connector member. An elongated locking section of the latch, with a elongated lip between the pivot end and the clamp end fixedly secures the connector members together. The other leg of the U-shaped member is a straight clip section with a beveled edge for engaging one of the connector members.

For a better understanding of the present inventor, reference may be made to the accompanying drawings wherein the same reference numerals have been applied to like parts and wherein:

FIG. 1 is an exploded isometric drawing of a connector assembly incorporating the present invention:

FIG. 2 is an isometric drawing showing the connector latch in the closed position; and FIGS. 3 and 4 are opposite end views of the present invention.

With reference to drawings, there is generally shown a first connector head 12 comprising a first plurality of electrical terminals 14, each being individually and rigidly supported in a terminal block 16. The connector head 12 is any suitably molded insulating material that can rigidly secure the electrical terminals in a spaced relationship. The first plurality of electrical terminals extend through the terminal block 16 and are disposed in an elongated, rectangular shaped recess defined by an elongated circular rim 18 forming one part of the connector head 12. Attached to the elongated circular rim 18 is a flat rectangular plate 22 having segments extending beyond the circular rim, each of the segments defining a circular aperture 24.

A second plurality of electrical terminals are supported in a second connector head 30 in a suitably spaced relationship to provide electrical conductive engagement between the first plurality of terminals and the second plurality of terminals. The second connector head 30 is any suitable molded insulating material capable of supporting electrically conducting terminals in a fixed, spaced relationship. Extending from the rear of the second connector head are a plurality of electrical leads 34 electrically connected to the second plurality of electrical terminals.

The second conductor head includes a front face 38 having a plurality of openings 36 exposing the second plurality of electrical terminals and a rear face 40 having a plurality of openings through which extend the electrical leads 34 connected to the second plurality of electrical terminals. The second connector head 30 is essentially an integral unit having a rectangular shaped flat portion 42 with openings 44 at either end, the flat portion 42 being disposed between a elongated rectangular portion 46 with one side providing the front face 38 of the second connector head, and the rear face 40. The openings 44, provided in the opposite ends of the rectangular flat portion 42 are in alignment with the corresponding apectures 24 in the flat plate 22 of the first connector head 12. In prior art configurations, the first connector head 12 and the second connector head 30 are often secured together by suitably inserting the first pluality of electrical terminals into the openings 36 in the front face 38 of the second connector head and engaging bolts through the aligned apectures 24 of the flat plate 22 and the opening 44 or flat portion 42.

In accordance with the present invention, there is shown a connector latch 50 having a pivot end 52, a locking section 54, and a clamp end 56 for rigidly securing the first connector head 12 and the second connector head 30 into locked relationship. The pivot end 52 includes a generally circular mid-section 58 with a hole 60, a protruding abutment 62 extending from the mid-section 58 to abut the circular rim 18 when the latch 50 is in an open position, and a stiffener 66 to offset undesirable flexibility and tranverse movement of the latch 50. A suitable bolt 68 extends through the opening 44 of the flat portion 42 and into the hole 60 of the circular mid-section 58 to fix the connector latch 50 into engagement with the second connector head. The bolt 68 then extends through the aperture 24 of the flat plate 22 to secure the second connector head 30 and lock 50 to the first connector head 12. The connector latch thus is adapted for pivoting motion about the screw. Without the stiffener 66, there would be undesirable wobble and movement of the latch 50 laterally with respect to the mated connector heads.

The locking section 54 integral with the pivot end 52 is a generally flat rectangular piece with a depending elongated lip 70. The clamp end is a U-shaped section and a tab 72 for grasping the connector latch 50 to open and close in the direction of the arrows, as shown in FIG. 2. One leg of the U-shaped section is an S-shaped spring 74, the other leg being an essentially straight member 76 with a beveled edge 78. One crest of the S-shaped spring 74 snaps into engagement with the opening 44 of the flat portion 42 on the second connector head 30. The straight member 76 resiliently engages one side of the flat plate 22 of the first connector head 12. The depending elongated lip 70 integral with the straight member 76 locks into engagement with the same side of the flat plate 22.

In operation, the connector latch secured to the second connector head 30 is pivoted approximately 15° to 20° from the horizontal to allow for clearance for the mating of the second connector head 30 to the first connector head 12. This is controlled by abutment 62 coming in contact with circular rim 18. The two connector heads are mated by fitting the inner wall 18*a* of the circular rim 18 over the outer wall 46*a* of the elongated rectangular portion 46 of the second connecting head 30. This aligns the first plurality of electrical terminals 14 with the plurality of openings 36 in the front face 38 of the second connector head. As the rim 18 begins slipping over the rectangular portion 46, it makes contact with chamber 62*a* on protruding abutment 62 pushing latch 50 in a counter clockwise direction. Thus pivots the connector latch slightly downward toward the connector head assembly. This also initially aligns the locking section 54 of the connector latch in overlying relationship with the mated connector assembly.

The first connector head is moved forward into engagement with the second connector head until the top edge of the rim on the first connector head abuts the flat portion on the second connector head. At this point, the connector latch 50 is pivoted downwardly and the nub 74*a* on the crest of the S-shaped spring 74 is forced over the edge of the flat portion 42 and downwardly along the flat portion until the nub 74*a* is seated into the opening 44, snapping the connector latch 50 to the connector head assembly. At the same time, the beveled edge 78 on the straight member 76 opposite the S-shaped spring engages the edge of the flat plate 22 on the first connector head 12 and is resiliently pushed outwardly to force the member 76 and elongated lip 70 into tight engagement with the rear edge of the flat plate 22. The resilient action of the S-shaped spring 74 and the straight member 76 and lip 70 locks the connector heads together. In order to disengage the connector latch 50, pressure is applied to the tab 72 upwardly to disengage the nub 74*a* on the S-shaped spring 74 from the opening in the flat portion and the connector latch is pivoted approximately 15° to 20° from the horizontal out of contact with the flat plate 22 of connector head 12.

This provides an easy to operate connector latch that remains on one of the connector heads. It is easily pivoted upward to allow engagement of the connector heads, and then easily downward to lock the connector heads together. To disengage the connector heads, it is only necessary to push the latch 50 upward, using pressure on the tab 72 and pull the connector heads apart.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. A connector assembly for securing a pair of mating electrical connector members together in a mated condition comprising a pair of mating electrical connector members, one of the connector members having an elongated rim, and a connector latch including a pivot end secured to one of the electrical connector members for pivoting the latch with respect to said one of the electrical connector members, an elongated locking section integral with the pivot end for engaging the elongated rim, and a clamp end having a spring portion for snapping the latch onto the connector members, the clamp end being a U-shaped section with a tab for grasping the connector latch to open and close the connector latch, one leg of the U-shaped section being an S-shaped spring, the other leg of the U-shaped section being an essentially straight clamp with a beveled edge.

2. The connector latch of claim 1 wherein the pivot end includes a circular mid-section with an aperture, a protruding abuttment extending from the mid-section to abut one of the electrical connector members, and a stiffener portion to offset flexibility, the aperture adapted to receive a fixing device to secure the pivot end to one of the connector members.

3. The connector latch of claim 1 wherein the elongated locking section is a generally flat rectangular piece with a depending elongated lip, the elongated lip engaging the elongated rim.

4. The connector latch of claim 1 wherein the S-shaped spring includes a nub for snapping into engagement with an aperture on said other of the pair of electrical connector members.

5. The connector latch of claim 4 wherein the straight clamp with the beveled edge is disposed in friction engagement with said one of the pair of electrical connector members.

6. A connector latch for securing a pair of mating electrical connector members together in a mated condition, one of the connector members having an elongated rim, comprising:

a pivot end having a circular mid section with an aperture, a protruding abutment extending from the mid-section to abut one of the electrical connector members; and a stiffener portion, the aperture adapted to receive a fixing device to secure the pivot end to one of the connector members;

an elongated locking section integral with the pivot end the elongated locking section being a generally flat rectangular piece with a depending elongated lip, for engaging the elongated rim; and a clamp end having a spring portion for snapping the latch onto the connector members, the clamp end being a U-shaped section with a tab for grasping the connector latch to open and close the connector latch;

one leg of the U-shaped section is an S-shaped spring, the other leg of the U-shaped section being an essentially straight member with a beveled edge.

7. The connector latch of claim 6 wherein the S-shaped spring includes a nub for snapping into engagement with a aperture on said other of the pair of electrical connector members.

* * * * *